US008359815B2

(12) United States Patent
Ansaloni et al.

(10) Patent No.: US 8,359,815 B2
(45) Date of Patent: Jan. 29, 2013

(54) MACHINE FOR FILLING CAPSULES WITH PHARMACEUTICAL PRODUCTS

(75) Inventors: Angelo Ansaloni, Crespellano (IT); Ernesto Gamberini, Rastignano (IT)

(73) Assignee: MG 2—S.R.L., Pianoro (IT)

( * ) Notice: Subject to any disclaimer, the term of this patent is extended or adjusted under 35 U.S.C. 154(b) by 378 days.

(21) Appl. No.: 12/855,834

(22) Filed: Aug. 13, 2010

(65) Prior Publication Data

US 2011/0023414 A1 Feb. 3, 2011

Related U.S. Application Data

(63) Continuation of application No. 12/776,718, filed on May 10, 2010.

(30) Foreign Application Priority Data

May 11, 2009 (IT) ..... BO09A00294
May 11, 2009 (IT) ..... BO09A00295

(51) Int. Cl.
*B65B 1/10* (2006.01)
*B65B 1/24* (2006.01)

(52) U.S. Cl. ..... 53/282; 53/529; 53/900

(58) Field of Classification Search ..... 53/281, 53/282, 529, 900
See application file for complete search history.

(56) References Cited

U.S. PATENT DOCUMENTS

| | | | | |
|---|---|---|---|---|
| 3,587,671 | A | 6/1971 | Gamberini | |
| 3,601,954 | A | 8/1971 | Aronson | |
| 3,675,390 | A * | 7/1972 | Austin | 53/282 |
| 3,847,191 | A | 11/1974 | Aronson | |
| 4,163,354 | A * | 8/1979 | Austin | 53/436 |
| 4,594,066 | A * | 6/1986 | Graham | 425/151 |
| 4,615,165 | A * | 10/1986 | Gamberini | 53/282 |
| 4,731,979 | A * | 3/1988 | Yamamoto et al. | 53/529 |
| 4,870,808 | A * | 10/1989 | Romagnoli | 53/529 |
| 5,111,642 | A * | 5/1992 | Chiari | 53/529 |
| 5,653,097 | A * | 8/1997 | Hill | 56/340.1 |
| 5,743,069 | A * | 4/1998 | Ansaloni | 53/282 |
| 6,327,835 | B1 * | 12/2001 | Trebbi | 53/53 |
| 6,799,409 | B2 * | 10/2004 | Altvater et al. | 53/122 |
| 7,392,636 | B2 * | 7/2008 | Conti | 53/433 |
| 7,640,953 | B2 * | 1/2010 | Ansaloni | 141/147 |
| 7,661,248 | B2 * | 2/2010 | Conti | 53/529 |
| 2009/0205748 | A1 * | 8/2009 | Ansaloni | 141/250 |

FOREIGN PATENT DOCUMENTS

| | | |
|---|---|---|
| DE | 20 48 948 A1 | 4/1971 |
| DE | 20 50 885 A1 | 4/1971 |
| DE | 34 32 992 A1 | 3/1985 |
| GB | 1 205 371 A | 9/1970 |
| WO | 03/094824 A1 | 11/2003 |

* cited by examiner

*Primary Examiner* — Hemant M Desai
*Assistant Examiner* — Gloria R Weeks
(74) *Attorney, Agent, or Firm* — Gottlieb, Rackman & Reisman, P.C.

(57) ABSTRACT

In a machine for filling capsules with pharmaceutical products, the bottom of each capsule is moved forward along a path determined in phase with a dosing device, which transfers the pharmaceutical product from a tank to the bottom, and has a cylinder, a piston engaged in the cylinder, a spring interposed between the cylinder and the piston for normally maintaining the piston in contact with a stopping element, and a tappet carried by the cylinder, engaged in a cam, and adapted to move the cylinder and the piston with respective mutually identical laws of motion.

9 Claims, 11 Drawing Sheets

MACHINE FOR FILLING CAPSULES WITH PHARMACEUTICAL PRODUCTS

This application is a Continuation of U.S. Ser. No. 12/776,718, U.S. Publication 2001/0023414 filed May 10, 2010, the content of which is incorporated herein by reference.

The present invention relates to a machine for filling capsules with pharmaceutical products.

BACKGROUND OF THE INVENTION

In the pharmaceutical industry, a machine for filling capsules with powdery pharmaceutical products is known, comprising a conveyor device which is continuously movable along a given path, and is provided with a number of pockets, each adapted to receive a respective bottom of a corresponding capsule; a rotating container containing the pharmaceutical product; and a dosing wheel mounted to continuously rotate about a longitudinal axis thereof.

The dosing wheel is provided with at least one dosing device, which is moved forward by the dosing wheel firstly through a sampling station where a given amount of product is sampled from the container and then along a portion of the aforesaid path in phase with a corresponding pocket for transferring the product into the corresponding bottom.

The dosing device comprises a cylinder and piston axially movable under the bias of an actuating device comprising, in turn, first and second cams extending about the longitudinal axis of the dosing wheel, a first tappet carried by the cylinder and engaged in the first cam, and a second tappet carried by the piston and engaged in the second cam.

The known machines for filling capsules with pharmaceutical products of the above-described type, although widely tried and tested, have some drawbacks mainly deriving from that the two cams needed to control the axial movements of cylinder and piston should be manufactured with the utmost accuracy and with relatively small tolerances, and are therefore relatively complex and costly.

SUMMARY OF THE INVENTION

It is an object of the present invention to provide a machine for filling capsules with pharmaceutical products which is free from the above-described drawbacks and which is simple and cost-effective to be implemented.

According to the present invention, a machine for filling capsules with pharmaceutical products is provided as claimed in the attached claims.

BRIEF DESCRIPTION OF THE DRAWINGS

The present invention will now be described with reference to the accompanying drawings, which illustrate a non-limitative embodiment thereof, in which.

DETAILED DESCRIPTION OF THE INVENTION

Figure 1:
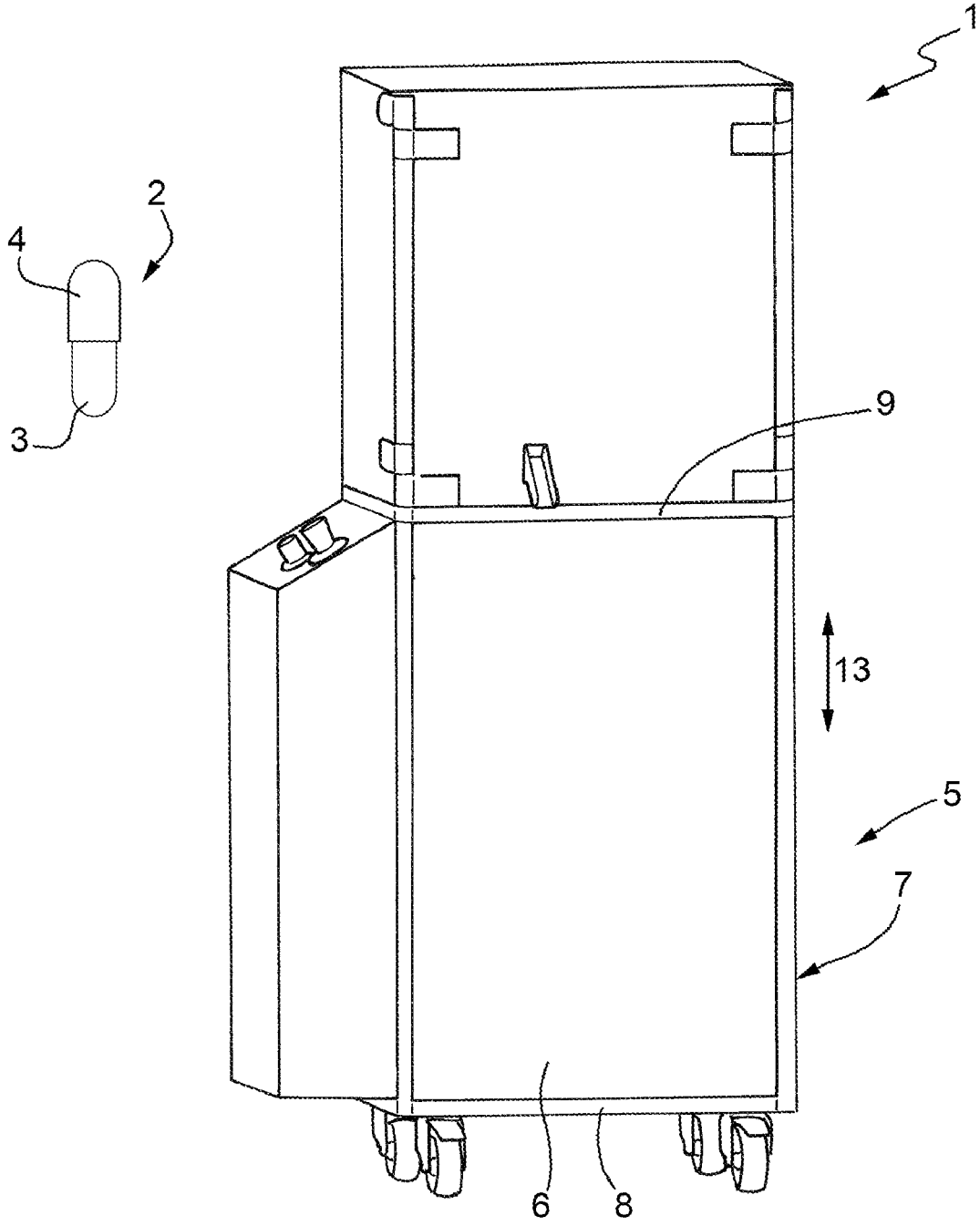
FIG. 1 is a schematic perspective view of a preferred embodiment of the machine of the present invention.
Figure 3:
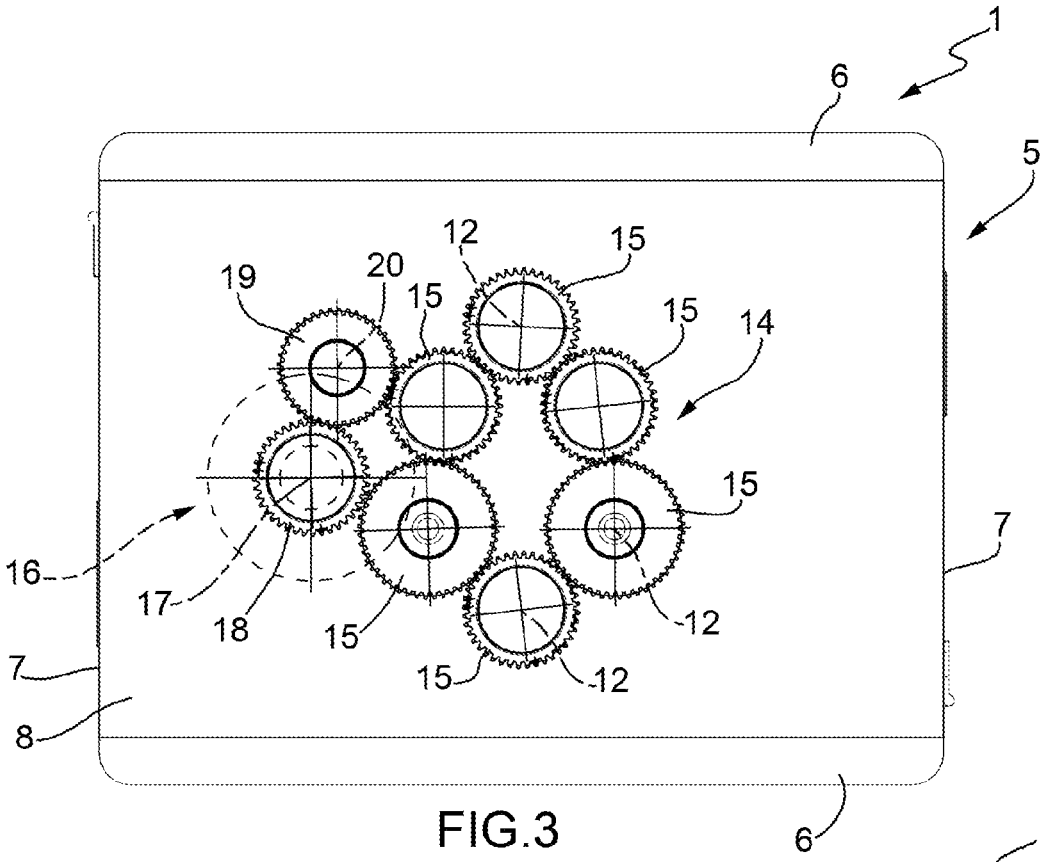
FIGS. 2 and 3 show two schematic plan views, with parts removed for clarity, of the machine in FIG. 1.
Figure 2:
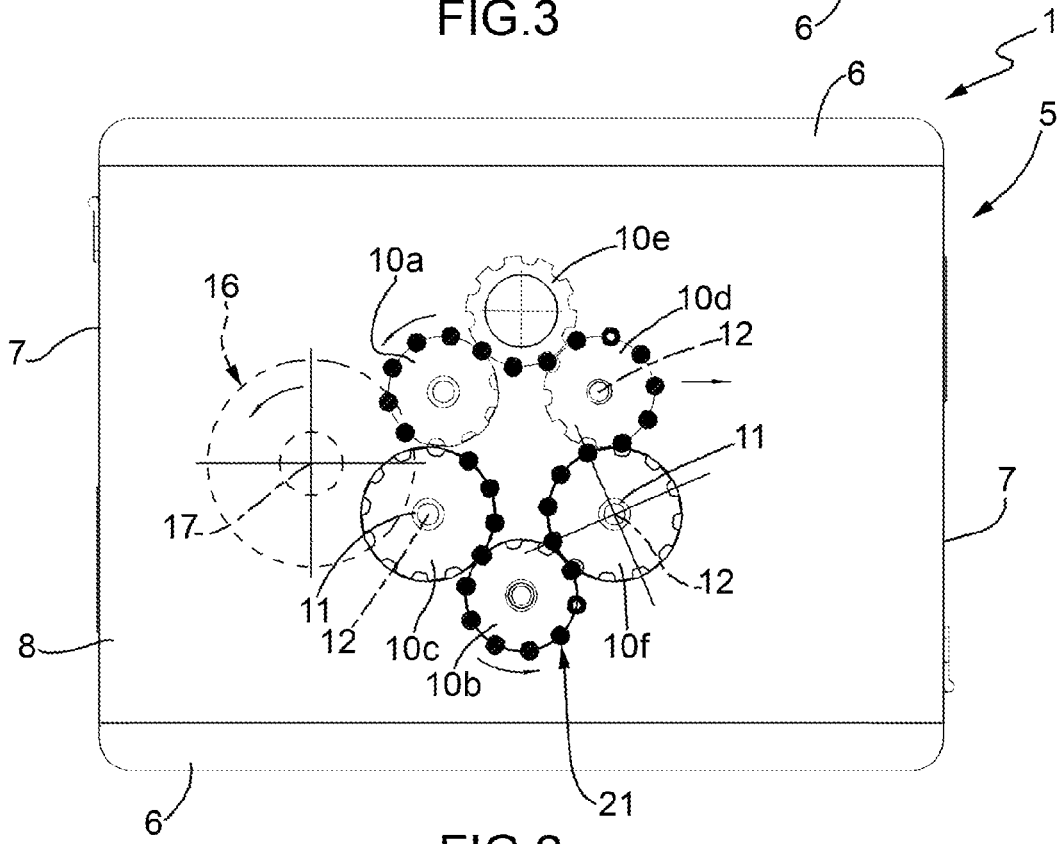

With reference to FIGS. 1, 2, and 3, numeral 1 indicates as a whole a machine for filling capsules 2 with pharmaceutical products, adapted to be preferably used in laboratories and pharmacies for the production of small lots.

Each capsule 2 comprises a substantially cup-shaped bottom 3 and a closing cap 4 of the bottom 3 itself.

Machine 1 comprises a box-like containing frame 5, which has a substantially parallelepiped shape, and which is delimited by two substantially vertical, side walls 6 which are parallel to each other, by two side walls 7 which are parallel to each other and perpendicular to the walls 6, by a substantially horizontal bottom wall 8 perpendicular to the walls 6 and 7, and by an upper wall 9 substantially parallel to the wall 8 itself.

Machine 1 further comprises a train of wheels 10, each of which comprises, in turn, a tubular upright 11, which has a longitudinal axis 12 substantially parallel to a vertical direction 13, is accommodated within the frame 5, protrudes from the top outside the frame 5 through the wall 9, and is pivotally coupled to the frame 5 to continuously rotate about axis 12 with respect to the frame 5 itself.

The uprights 11 are rotated about the axes 12 thereof by an actuating device 14 comprising a gear 15, keyed onto each upright 11 under wall 9, and a drum 16 which has a longitudinal axis 17 parallel to the axes 12, and carries a gear 18 keyed thereto coupled to both an inlet gear (not shown) keyed onto the outlet shaft of an electric motor of known type (not shown), and an intermediate gear 19 mounted to rotate about a longitudinal axis 20 thereof parallel to direction 13.

Figure 4:
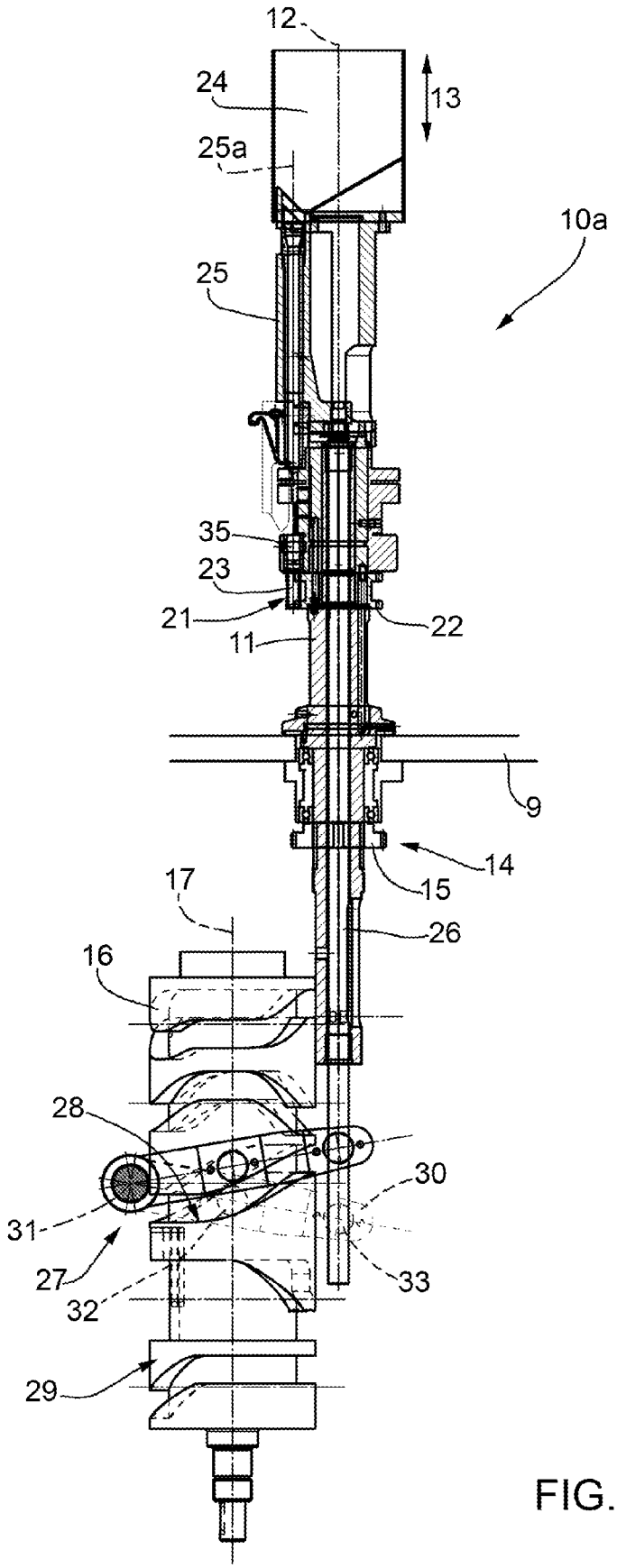
FIG. 4 is a schematic side view, with parts in section and parts removed for clarity, of a first detail of the machine in FIG. 1.

As shown in FIG. 4, machine 1 is further provided with a pocket conveyor 21, which is looped about a plurality of sprockets 22, each keyed onto a corresponding upright 11 over wall 9, and is provided with a plurality of pockets 23 which are cup-shaped with the concavity facing upwards, are uniformly distributed along the conveyor 21, are each adapted to accommodate a respective bottom 3 arranged with the concavity thereof facing upwards, and are continuously moved forward by the conveyor 15 itself along a path P extending about wheels 10.

Figure 5:
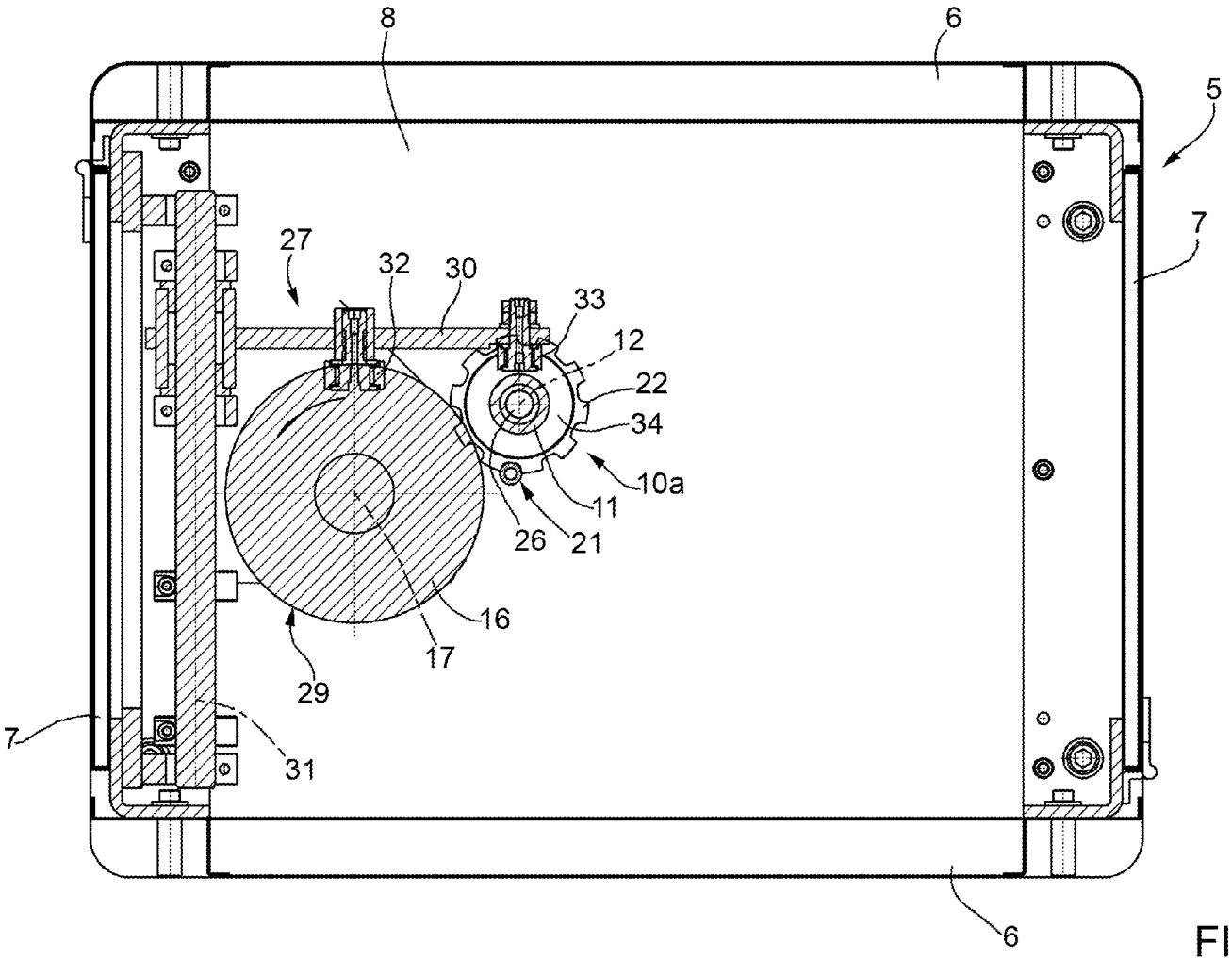
FIG. 5 is a schematic plan view, with parts in section and parts removed for clarity, of the detail in FIG. 4.

With reference to FIGS. 2, 4, and 5, the train of wheels 10 comprises a feeding wheel (hereinafter indicated by 10*a*) comprising, in turn, a hopper 24 containing the capsules 2, fixed at an upper end of the corresponding upright 11, and a feeding tube 25 which has a longitudinal axis 25*a* parallel to the corresponding axis 12, extends through a bottom wall of the hopper 24, and is fixed through a radial slot obtained through the corresponding upright 11 to an actuating shaft 26 accommodated within the corresponding upright 11, coaxially to the corresponding axis 12. The shaft 26 protrudes outwards from the bottom of the corresponding upright 11, and is slidingly coupled and angularly fixed to the corresponding upright 11 to perform rectilinear movements in direction 13 with respect to the hopper 24 and under the bias of a cam-actuating device 27.

Device 27 comprises a cam 28 obtained on an outer surface 29 of the drum 16 coaxially to axis 17, and a crank 30, which is hinged to the frame 5 to oscillate with respect to frame 5 about a fulcrum axis 31 transversal to axis 17, supports a tappet roller 32 engaged in the cam 28 at an intermediate point thereof, and is provided with a coupling roller 33 pivotally mounted at one end of the crank 30 and engaged between two annular plates 34 parallel to each other, fixed to the shaft 26 orthogonally to the corresponding axis 12.

Tube 25 cooperates with a resting blade and with an orientation blade (known and not shown) to orient each capsule 2 with the cap 4 arranged over the bottom 3, and further cooperates with a substantially cylindrical seat 35, which is obtained through a peripheral edge of the corresponding upright 11 parallel to direction 13, extends over the conveyor 21, is aligned with the tube 25 in the direction 13 itself, and comprises a flared upper portion adapted to hold a cap 4 and a narrowed lower portion adapted to accommodate a bottom 3 therein.

The orientation and opening of each capsule 2, the separation of each bottom 3 from the corresponding cap 4, and the feeding of each bottom 3 into a corresponding pocket 23 of conveyor 21 are carried out by means of a known operating sequence described, for example, in U.S. Pat. No. 4,615,165, entirely incorporated herein by reference.

With this regard, it is worth noting that machine 1 is dimensioned so that the bottoms 3 are uniformly distributed along the conveyor 21 at a given distribution step. In other words, the bottoms 3 are only accommodated within some pockets 23, while the remaining pockets 23 are empty.

Figure 6:
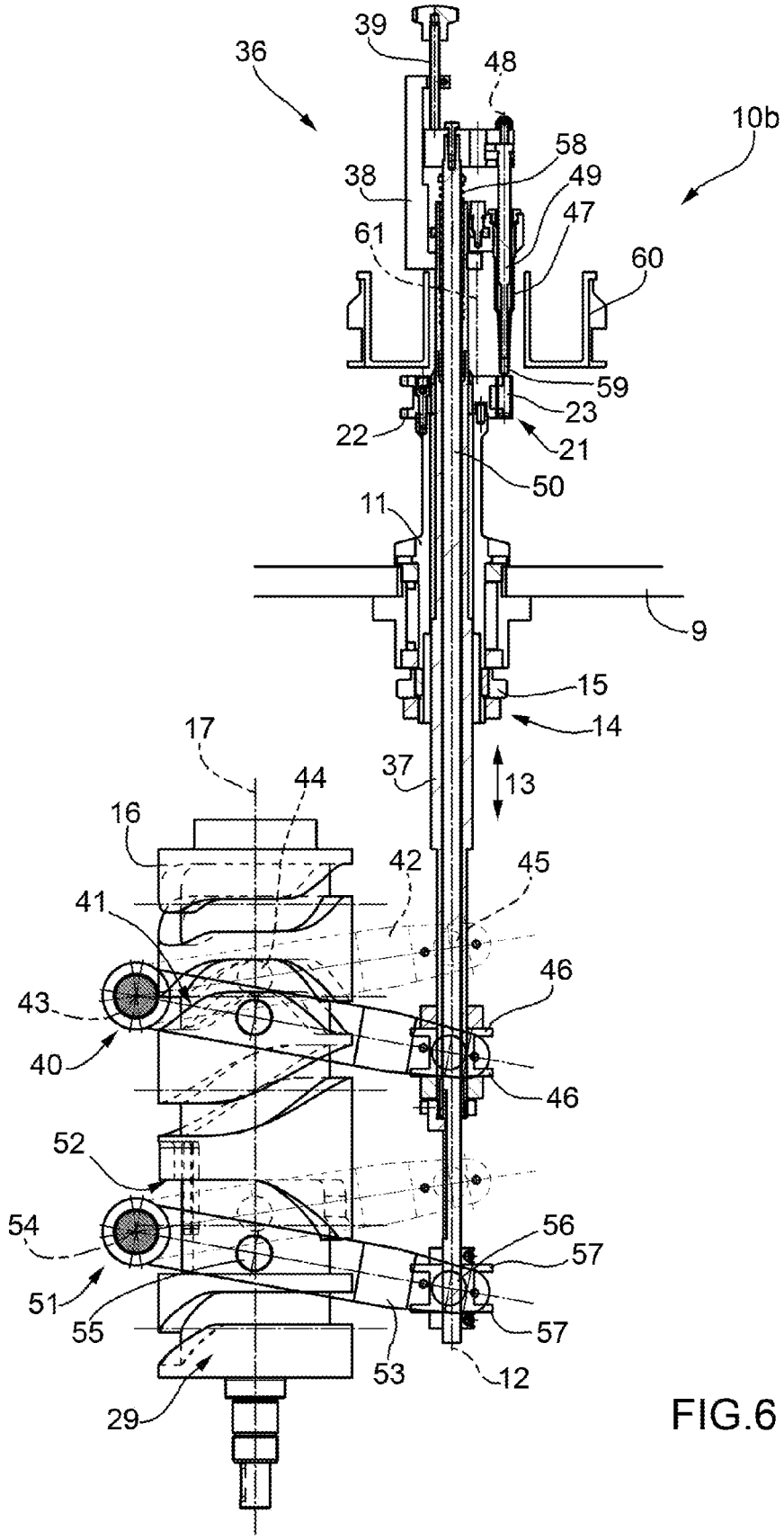
FIG. 6 is a schematic side view, with parts in section and parts removed for clarity, of a second detail of the machine in FIG. 1.
Figure 7:
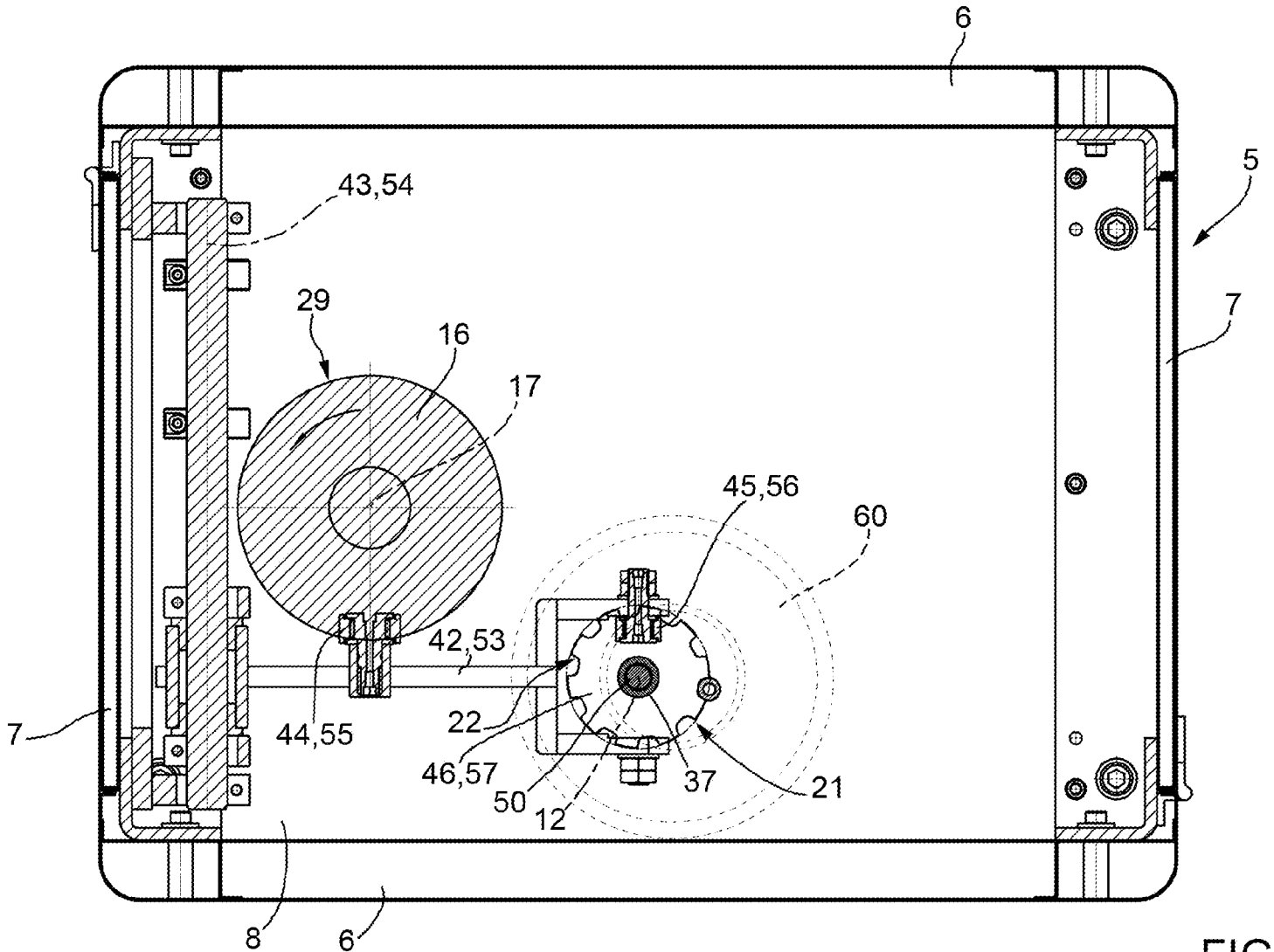
FIG. 7 is a schematic plan view, with parts in section and parts removed for clarity, of the detail in FIG. 6.

As shown in FIGS. 2, 6, and 7, the train of wheels 10 further comprises a dosing wheel (hereinafter indicated by 10*b*) connected to the wheel 10*a* by interposing a transfer wheel (hereinafter indicated by 10*c*) and provided with a dosing device 36 comprising, in turn, a sleeve 37 which is mounted within the corresponding upright 11 coaxially to the corresponding axis 12, protrudes outside the corresponding upright 11 in direction 13, and carries a keyed supporting bracket 38 at an upper end thereof, which bracket 38 is provided with a regulating screw 39 screwed through the bracket 38 parallel to direction 13.

Sleeve 37 is coupled in an angularly fixed and axially sliding manner to the corresponding upright 11 to perform rectilinear movements in direction 13 with respect to the corresponding upright 11 itself, under the bias of a cam-actuating device 40, comprising a cam obtained on the outer surface 29 of the drum 16 coaxially to axis 17, and a crank 42 which is hinged to the frame 5 to oscillate with respect to the frame 5 about a fulcrum axis 43 transversal to axis 17, supports a tappet roller 44 engaged in the cam 41 at an intermediate point thereof, and is provided with a coupling roller 45 pivotally mounted at one end of the crank 42 and engaged between two annular plates 46 parallel to each other and fixed to the sleeve 37, orthogonally to the corresponding axis 12.

Device 36 further comprises a dosing cylinder 47, which has a longitudinal axis 48 parallel to the corresponding axis 12, and is fixed at an upper end of the sleeve 37, and a dosing piston 49 which extends within the cylinder 47 and is fixed at an upper end of an actuating shaft 50, which extends into the sleeve 37 coaxially to the corresponding axis 12, protrudes outwards from the sleeve 37, and is coupled in an angularly fixed and axially sliding manner to the sleeve 37 to perform rectilinear movements in direction 13 with respect to the sleeve 37 itself under a cam-actuating device 51.

Device 51 comprises a cam 52 obtained on an outer surface 29 of the drum 16 coaxially to axis 17, and a crank 53, which is hinged to frame 5 to oscillate with respect to the frame 5 about a fulcrum axis 54 transversal to the axis 17, supports a tappet roller 55 arranged inside the cam 52 at an intermediate point thereof, and is provided with a coupling roller 56 pivotally mounted at one end of the crank 53 and engaged between two annular plates 57 parallel to each other and fixed to the shaft 50 orthogonally to the corresponding axis 12.

As the height of cam 52, measured parallelly to direction 13, is greater than the diameter of roller 55, the shaft 50 and the piston 49 are normally maintained in a raised position by a spring 58 interposed between sleeve 37 and shaft 50, where the shaft 50 is arranged in contact with the screw 39, and the piston 49 is arranged at a given distance from the lower end of the cylinder 47 to define a dosing chamber 59, the volume of which depends on the position of the screw 39 in direction 13.

From the above description, it results that the cylinder 47 and the piston 49 are normally moved in direction 13 according to mutually identical motion laws only under the bias of device 40.

The dosing wheel 10*b* further comprises an annular container 60, which is adapted to contain a powered pharmaceutical product therein, is mounted over the corresponding sprocket 22, and is pivotally coupled to frame 5 to continuously rotate with respect to the frame 5 itself, about a longitudinal axis 61 substantially parallel to and distinct from the corresponding axis 12 at an angular speed substantially different from the angular speed of the corresponding upright 11 and of the corresponding sprocket 22 about the corresponding axis 12.

The eccentric assembly of the container 60 with respect to the assembly defined by the corresponding upright 11 and by the corresponding sprocket 22 determines the division of the circular trajectory of the dosing device 36 about the corresponding axis 12 into a first segment, where the dispensing chamber 59 faces the container 60 and is axially moved from and towards the container 60 to sample a predetermined amount of a pharmaceutical product from the container 60 itself, and into a second segment where the chamber 59 faces the corresponding pocket 23 to feed the newly sampled pharmaceutical product into the corresponding bottom 3.

With regards to the above description, it is worth noting that the piston 49 is moved with respect to the cylinder 47 by the device 51 only for compacting the pharmaceutical product contained in the chamber 59 and for unloading the pharmaceutical product into the chamber 59 of the corresponding bottom 3. The movement of piston 49 with respect to the cylinder 47 is controlled by two plugs (not shown) inserted into the cam 52, one of which is fixed in direction 13 and controls the unloading of the pharmaceutical product from chamber 59 and the other may be regulated in direction 13 according to the chemical-physical properties of the pharmaceutical product and controls the compacting of the pharmaceutical product in chamber 59.

Sampling the pharmaceutical product from container 60, compacting it within chamber 59, and feeding it into the corresponding bottom 3 occur by means of a known operating sequence described, for example, in European patent application n. 08425148.7 entirely incorporated here by reference.

From the above description, it results that the cam 52, the height of which is greater than the diameter of tube 55, may be made in a relatively simple, cost-effective manner, and that only the mentioned plugs (not shown) should be made with high accuracy and small tolerances.

Figure 8:
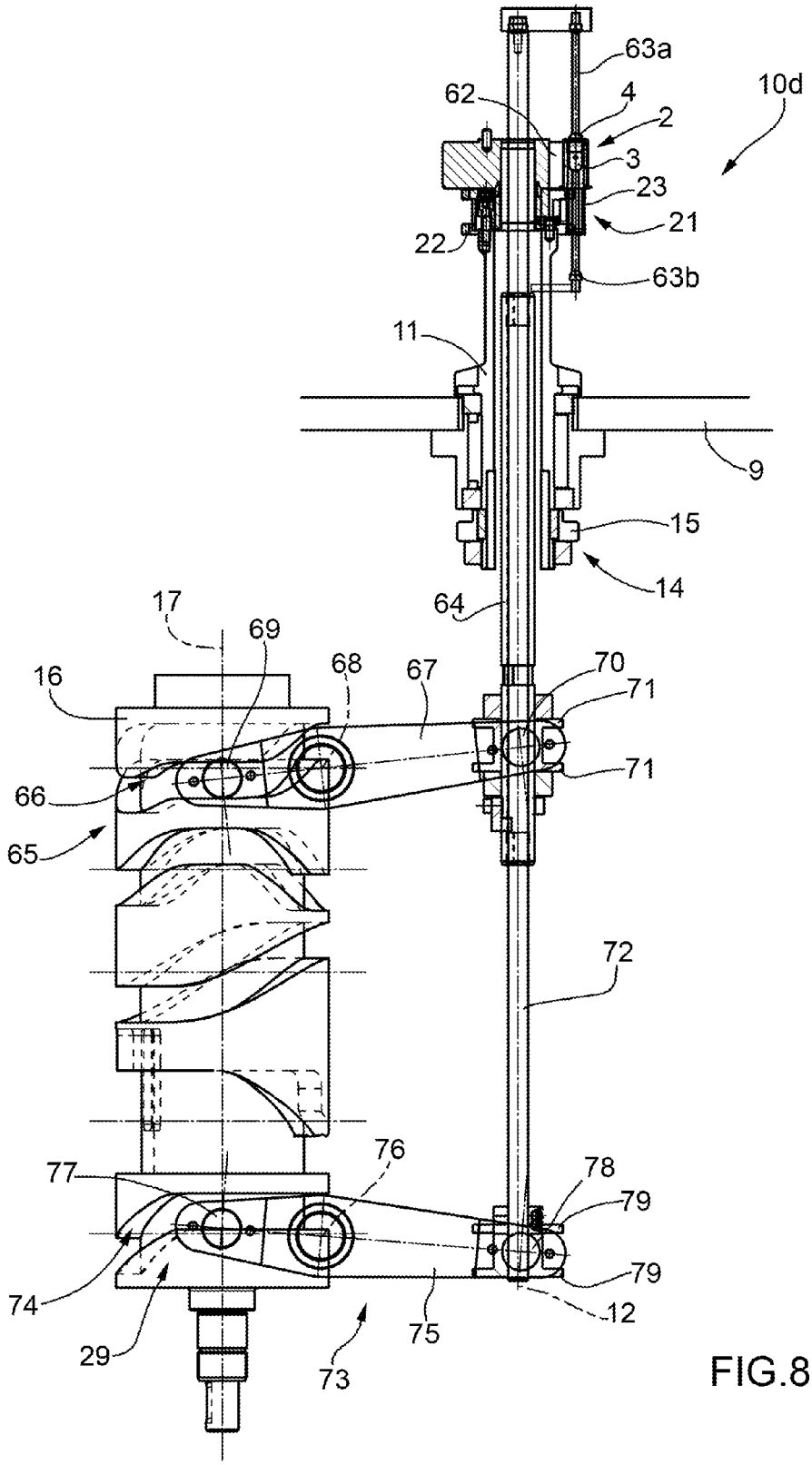
FIG. 8 is a schematic side view, with parts in section and parts removed for clarity, of a third detail of the machine in FIG. 1.
Figure 9:
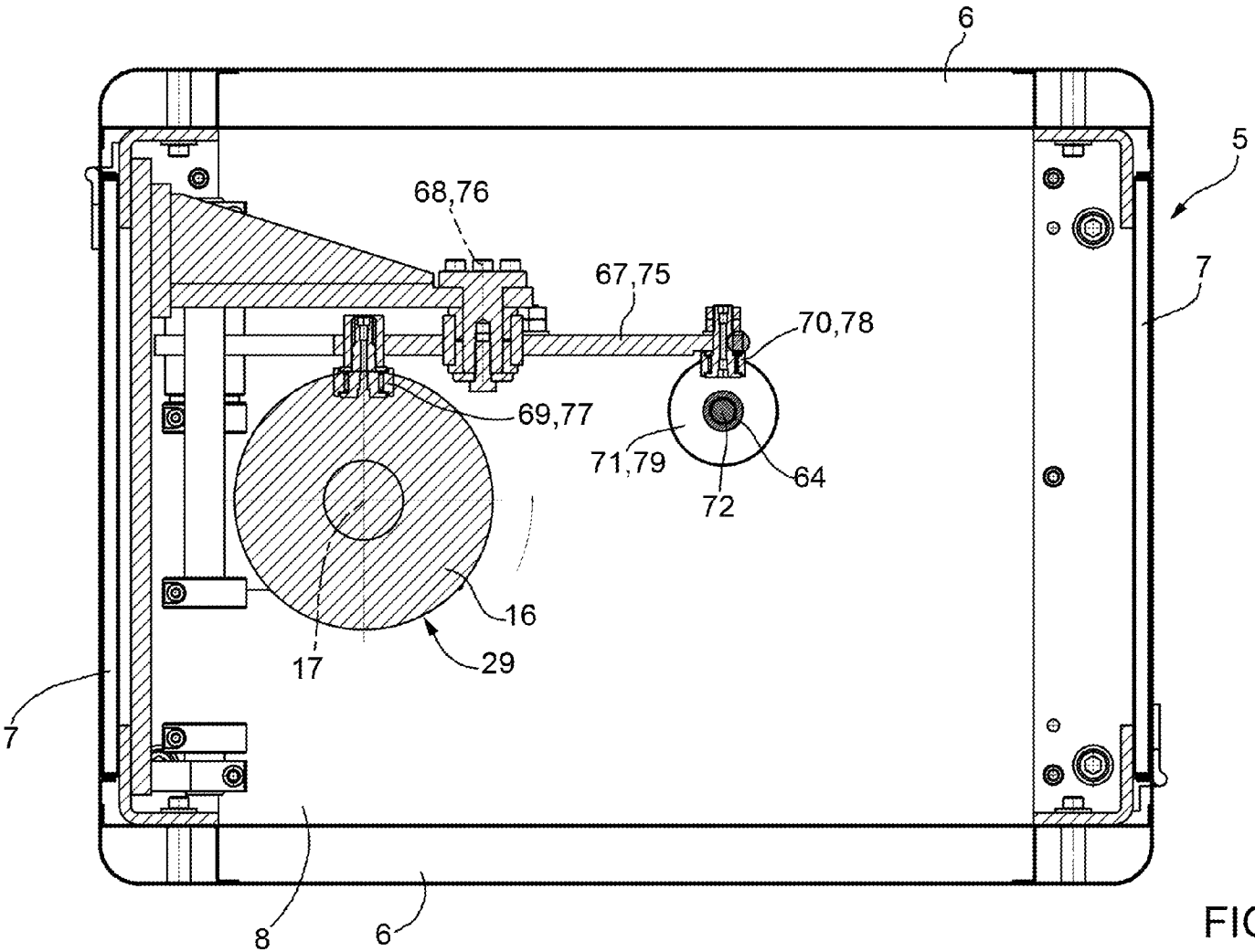
FIG. 9 is a schematic plan view, with parts in section and parts removed for clarity, of the detail in FIG. 7.

With reference to FIGS. 2, 8, and 9, the train of wheels 10 finally comprises a closing wheel (hereinafter indicated by 10*d*), which is connected to the feeding wheel 10*a* by interposing a transfer wheel (hereinafter indicated by 10*e*) so as to receive the caps 4 from the wheel 10*a* itself, and is further connected to the dosing wheel 10*b* by interposing a transfer wheel (hereinafter indicated by 10*f*) so as to receive the bottoms 3 filled with pharmaceutical product from the wheel 10*b* itself.

Wheel 10*d* has a substantially cylindrical seat 62, which is obtained along a peripheral edge of the wheel 10*d* parallelly to direction 13, is moved forward by the wheel 10*d* itself about the corresponding axis 12 in phase which each bottom 3 fed by the wheel 10*f* and with each cap 4 fed by the wheel 10*e*, and cooperates with two thrust members 63 opposed to each other, which extend parallel to the corresponding axis 12, are aligned with each other in direction 13, and are arranged one (hereinafter indicated by 63*a*) over the other (hereinafter indicated by 63*b*).

The member 63*b* is fixed at an upper end of a sleeve 64, which is accommodated within the corresponding upright 11 coaxially to the corresponding axis 12, protrudes from the bottom outside the corresponding upright 11, and is coupled in an angularly fixed and axially sliding manner to the corresponding upright 11 to perform rectilinear movements in direction 13 with respect to the corresponding upright itself 11 under the bias of a cam-actuating device 65.

Device 65 comprises a cam 66 obtained on the outer surface 29 of the drum 16 coaxially to axis 17, and a rocker arm 67, which is hinged to frame 5 to oscillate with respect to the frame 5 about a fulcrum axis 68 transversal to axis 17, has a first arm provided with a tappet roller 69 engaged in the cam 66, and has a second arm provided with a coupling roller 70 mounted to rotate between two annular plates 71 parallel to each other and fixed to the sleeve 64 orthogonally to the corresponding axis 12.

The member 63*a* is fixed at an upper end of a shaft 72, which extends into the sleeve 64 coaxially to the corresponding axis 12, protrudes outwards from the sleeve 64, and is coupled in an angularly fixed and axially sliding manner to the sleeve 64 to perform rectilinear movements in direction 13 with respect to the sleeve 64 itself under the control of a cam-actuating device 73.

Device 73 comprises a cam 74 obtained on the outer surface 29 of the drum 16 coaxially to axis 17, and a rocker arm 75, which is hinged to frame 5 to oscillate with respect to the frame 5 about a fulcrum axis 76 transversal to axis 17, has a first arm provided with a a tappet roller 77 engaged in the cam 74, and has a second arm provided with a coupling roller 78 mounted to rotate between two annular plates 79 parallel to each other and fixed to the shaft 72 orthogonally to the corresponding axis 12.

Each cap 4 is transferred by the wheel 10*e* into the seat 62 and the closing of each cap 2 is carried out by means of an operating sequence known and described, for example, in U.S. Pat. No. 4,615,165, entirely incorporated herein by reference.

As all cams 28, 41, 52, 66, 74 are obtained on the drum 16 and the axis 17 of drum 16 is parallel to the axes 12 of wheels 10, machine 1 has relatively small dimensions and drum 16 has a diameter sufficient to ensure a correct operation of the cam-actuating devices 27, 40, 51, 65, 73.

Figure 10:
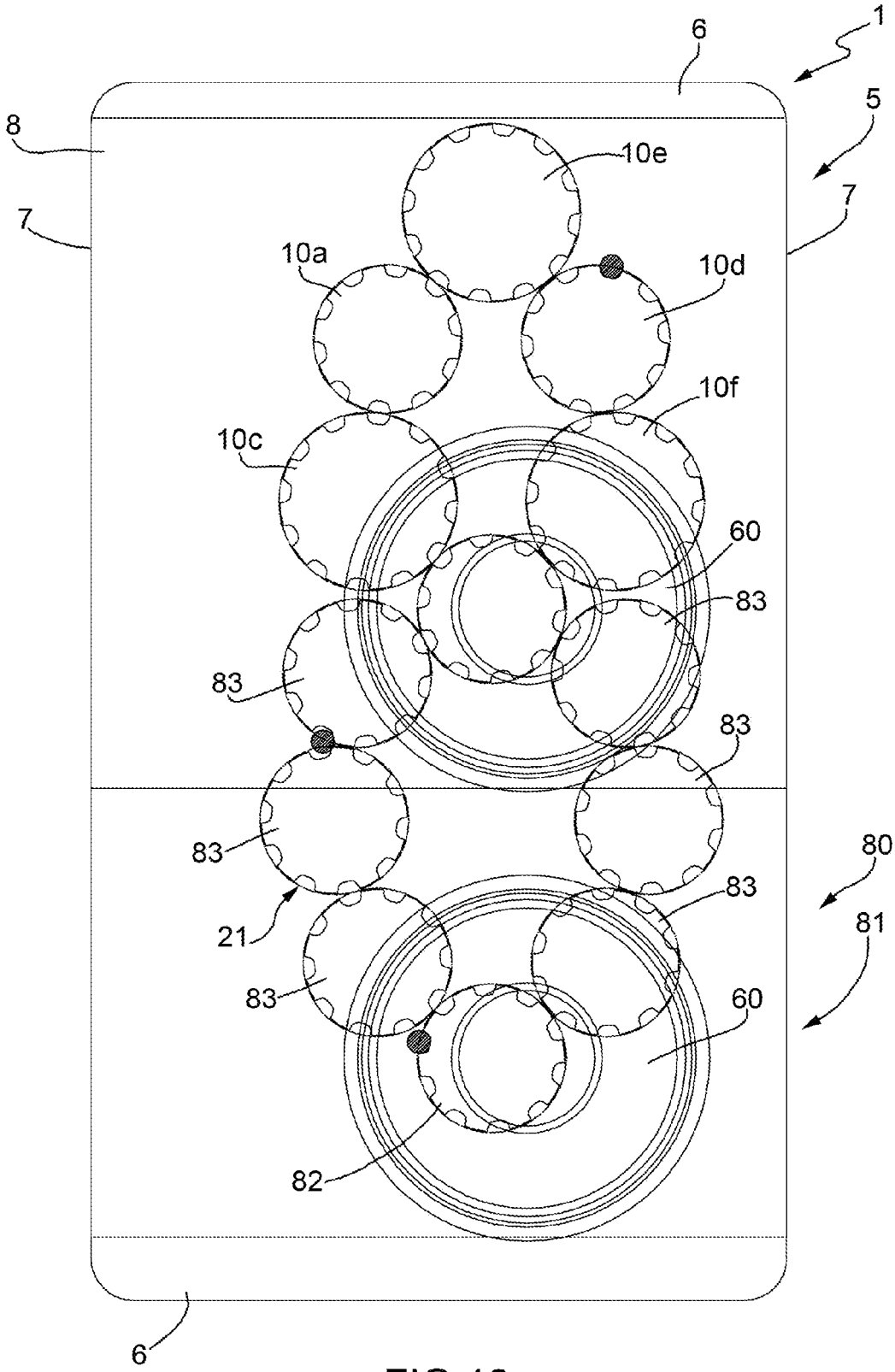
FIG. 10 is a schematic plan view, with parts removed for clarity, of a variant of the machine in FIG. 1.

With regards to the above description, it is worth noting that machine 1 has a modular structure. The variant shown in FIG. 10 thus differs from that shown in the previous figures in that one of the walls 6 is removed and machine 1 is provided with at least one further dosing module 80 comprising a supporting frame 81, which is entirely similar to the frame 5, is releasably coupled to frame 5, and is closed by the wall itself, a dosing wheel 82 entirely similar to the wheel 10*b*, and two sets of transfer wheels 83 entirely similar to the wheels 10*c*, 10*e*, and 10*f* and interposed between wheel 10*b* and wheel 82.

The wheels 82, 83 are provided with respective gears (not shown) entirely similar to the gears 15 and coupled to each other and to gear 15 of the wheel 10*b*, and are further provided with respective sprockets (not shown) entirely similar to the sprockets 22 and engaged in the pocket conveyor 21.

Moreover, module 80 comprises a further drum (not shown), which is entirely similar to the drum 16, is provided with a gear (not shown) coupled to the gears (not shown) of the wheels 82, 83 and defines part of a cam-actuating device (not shown) entirely similar to the devices 40, 51 and adapted to move the cylinder 47 and the piston 49 of wheel 82 in direction 13.

According to some variants (not shown), each dosing wheel 10*b*, 82 is suppressed and replaced either by a dosing assembly with a dosing chute of the type described, for example, in Italian patent application BO2008A000598 entirely incorporated herein by reference, or by a dosing assembly of known type for filling the capsules 2, for example with tablet and/or liquid pharmaceutical products. According to the fitted dosing assemblies, machine 1 is either intermittently or continuously actuated by an electronic control unit.

Figure 11:
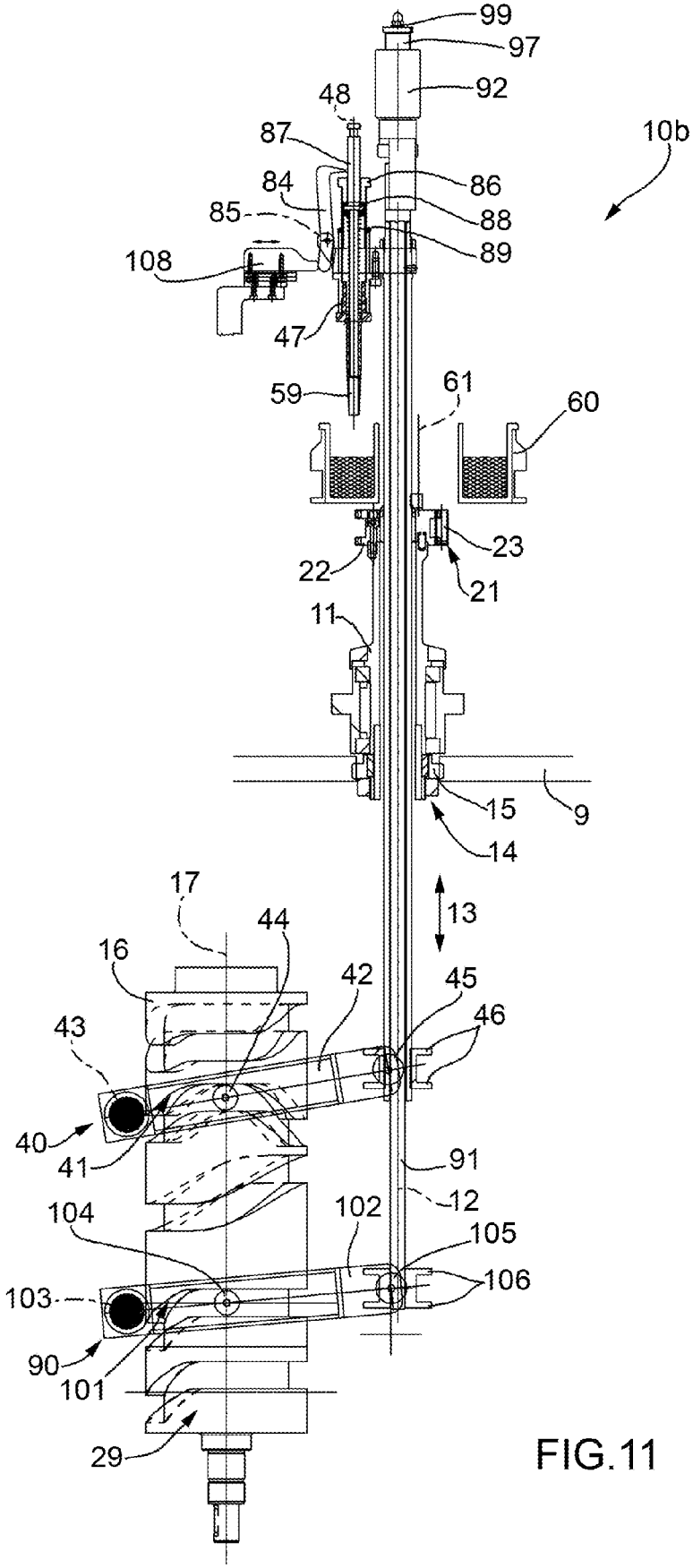
FIGS. 11 and 12 are two schematic side views, with parts in section and parts removed for clarity, of a variant of the detail in FIGS. 6 and 7 shown in two different operating positions.
Figure 12:
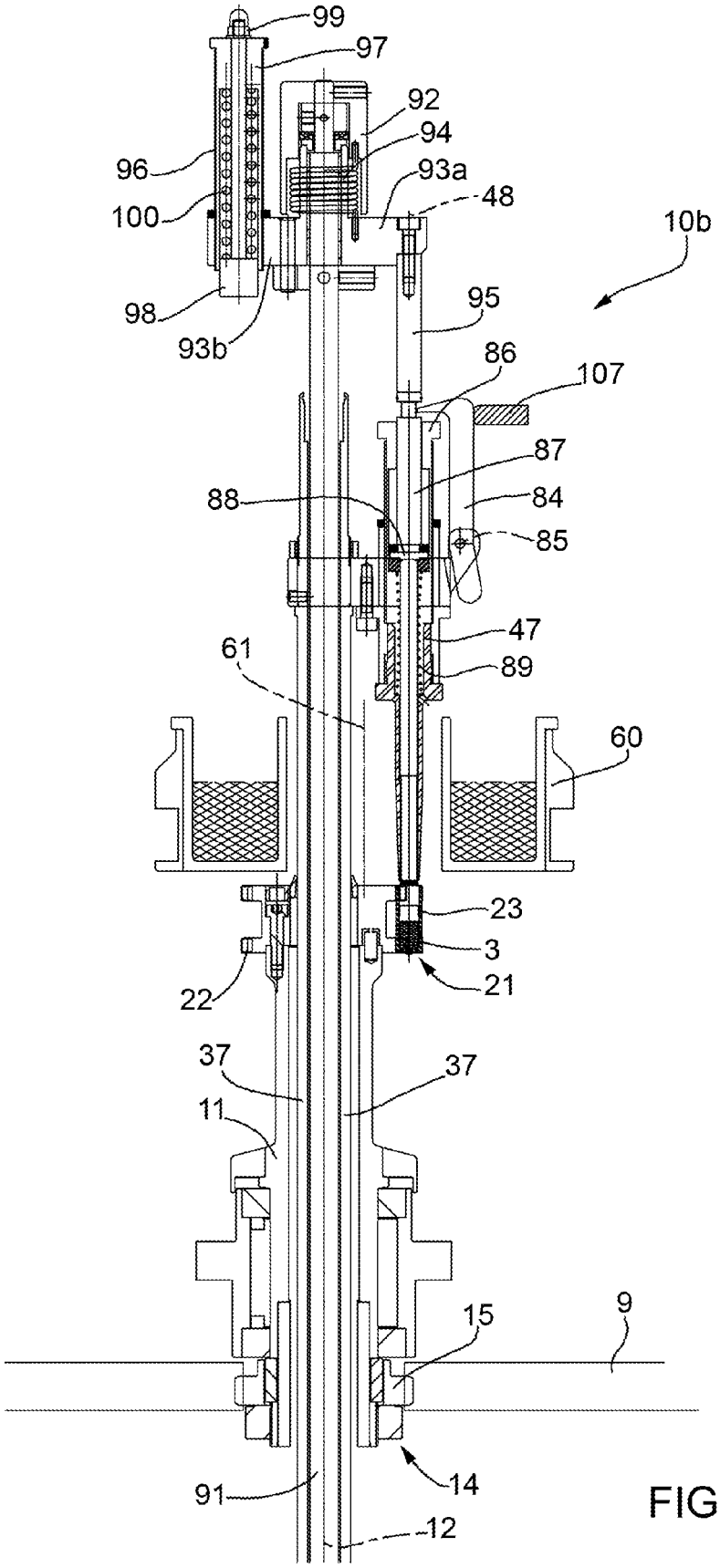

The variant shown in FIGS. 11 and 12 differs from that shown in FIGS. 6 and 7 in that:

bracket 38, screw 39, piston 49, shaft 50, and cam-actuating device 51 are suppressed;

cylinder 47 is provided with a rocker arm 84 hinged on the outer surface of the cylinder 47 to rotate with respect to the cylinder 47 itself about a fulcrum axis 85 transversal to axis 48; and cylinder 47 is closed at the top by a ring nut 86 screwed into the cylinder 47, and is slidingly engaged by a dosing piston 87, which extends through the ring nut 86, has an annular plate 88 mounted to the piston 87 orthogonally to axis 48, and is normally maintained in a lifted position in which the plate 88 is arranged in contact with the ring nut 86 for allowing the cylinder 47 and the piston 87 to define the dosing chamber 59, by a spring 89 interposed between the cylinder 47 and the piston 87 itself.

The movement of the ring nut 86 along axis 48 obviously allows to selectively control the raised position of piston 87 and thus the height and volume of chamber 59.

Piston 87 is moved with respect to the cylinder 47 in direction 13 to compact the pharmaceutical product contained in the chamber 59 and to unload the pharmaceutical product from the chamber 59 into the corresponding bottom 3 by means of a cam-actuating device 90 comprising an actuating shaft 91, which slidingly engages the sleeve 37, is angularly fixed about the corresponding axis 12, protrudes from the top outside the sleeve 37, and supports a substantially cylindrical bell 92 which is coaxial to the corresponding axis 12, is mounted at a lower end of the shaft 91 with the concavity thereof facing downwards, has two arms 93 radially protruding outwards from a lower end of the bell 92, and is pivotally coupled to shaft 91 by interposing a torsion spring 94 to oscillate with respect to shaft 91 about the corresponding axis 12 itself.

One of the arms 93 (hereinafter indicated by 93*a*) supports a strut 95, which extends downwards from the arm 93*a* itself in direction 13, and is arranged along the path of cylinder 47 and piston 87 about the corresponding axis 12, while the other arm 93 (hereinafter indicated by 93*b*) supports a sleeve 96, which extends upwards from the arm 91*b*, is closed at the top by a ring nut 97 screwed into the sleeve 96, and is closed at the bottom by a piston 98, which extends through the ring nut 97 to be screwed into a nut 99, is slidingly coupled to the sleeve 96 and to the ring nut 97, and is normally maintained in a lowered position, where the nut 99 is arranged in contact with the ring nut 97, by a spring 100 interposed between the sleeve 96 and the piston 98 itself.

The movement of the ring nut 97 in direction 13 obviously allows to selectively control the lowered position, and thus the height of piston 98.

Device 90 further comprises a cam 101 obtained on an outer surface 29 of the drum 16 coaxially to axis 17, and a crank 102, which is hinged to the frame 5 to oscillate with respect to frame 5, about a fulcrum axis 103 transversal to axis 17, supports a tappet roller 104 engaged within the cam 101 at an intermediate point thereof, and is provided with a coupling roller 105 pivotally mounted at one end of the crank 102 and engaged between two annular plates 106 parallel to each other and fixed to the shaft 91 orthogonally to the corresponding axis 12.

In use, shaft 91 is lowered by cam 101 and by crank 102 in direction 13 when the dosing device 36 moves thorough a sampling station of the pharmaceutical product from the container 60 to allow the piston 98 to lower the piston 87, and so the piston 87 to compact the pharmaceutical product in chamber 59, and when the dosing device 36 moves through an unloading station of the pharmaceutical product into the corresponding bottom 3 to allow the strut 95 to lower the piston 87 and so the piston 87 to unload the pharmaceutical product outside chamber 59.

Following the contact of piston 87 with the strut 95 and the piston 98, the bell 92 is pivotally fed by friction about the corresponding axis 12 against the bias of the spring 94 so as to avoid slipping between piston 87, strut 95, and piston 98; while, upon disengaging the piston 87 from the strut 95 and piston 98, the bell 92 is moved again to its initial position by the spring 94 itself.

Furthermore, it is worth noting that:

in the unloading station of the pharmaceutical product in the corresponding bottom 3, the rocker arm 84 is moved to a locking position of piston 87, in which the volume of chamber 59 is substantially zero, by a cam 107 fixed to the frame 5 (FIG. 12);

during the transfer from the unloading station to the sampling station of the pharmaceutical product from container 60, the rocker arm 84 is maintained in its locking position;

upstream of the sampling station, the rocker arm 84 is normally moved to a releasing position of the piston 87 by a cam 108, in which position the piston 87 is lifted again by the spring 89 to form the chamber 59, (FIG. 11); and cam 108 is normally arranged in an operating forward position (FIG. 11), in which the cam 108 engages the rocker arm 84 and moves it from its releasing position, and is moved to a retracted resting position (not shown), in which the cam 108 does not engage the rocker arm 84 thus avoiding the formation of chamber 59, when the pocket 23 (taken into account each time) is empty and free from the corresponding bottom 3, so as to avoid the dosing device 36 from feeding the pharmaceutical product into the empty pocket 23.

The invention claimed is:

1. Machine for filling capsules (2) with powdery pharmaceutical products, each capsule (2) comprising a bottom (3) and a cap (4) for closing the bottom (3), the machine comprising a conveyor device (21) to continuously move forward each bottom (3) along a determined path (P); a tank (60) containing at least a pharmaceutical product; at least a dosing wheel (10*b*) mounted to continuously rotate around a first rotation axis (12); at least a dosing device (36), which comprises two dosing elements (47, 87) engaged with each other, and is moved forward by the dosing wheel (10*b*) in the first place through a sampling station of a determined amount of pharmaceutical product from the tank (60) and then along a portion of the path (P) in phase with a relative bottom (3) to transfer the pharmaceutical product inside the bottom (3); an actuating device (40, 90) to axially move the dosing elements (47, 87) in a direction (13) parallel to said axis (12) and comprising a first cam (41) and a first tappet (44) supported by a first said dosing element (47) and engaged with the first cam (41); a stopping element (86); and pushing means (89) to move and, normally, to keep a second said dosing element (87) in contact with the stopping element (86); the two dosing elements (47, 87) being mobile in said direction (13) with respective identical laws of motion only under the thrust of the first tappet (44) and defining between them, when the second dosing element (87) is in contact with the stopping element (86), a dosing chamber (59) having a determined volume; the machine being characterized in that the actuating device (40, 90) further comprises a first actuating member (98), which is mounted in said sampling station, is mobile in said direction (13) to move the second dosing element (87) with respect to the first dosing element (47) and to compact the pharmaceutical product inside the dosing chamber (59), and is mounted to swing, under the thrust of the second dosing element (87) and against the action of a relative shock-absorbing device (94) around a second rotation axis (12) parallel to said direction (13).

2. Machine according to claim 1, wherein the position of the stopping element (86) in said direction (13) is adjustable to selectively control the volume of the dosing chamber (59).

3. Machine according to claim 1, wherein the first actuating member (98) is mobile in said direction (13) starting from its initial position; regulating means (97) being provided to selectively control the initial position of the first actuating member (98) in the direction (13) according to the kind of pharmaceutical product.

4. Machine according to claim 1, wherein the actuating device (40, 90) comprises a second actuating member (95) mounted in correspondence to said portion of the path (P) and mobile in said direction (13) to move the second dosing element (87) with respect to the first dosing element (47) and to unload the pharmaceutical product from the dosing chamber (59) into the relative bottom (3).

5. Machine according to claim 4, wherein the actuating device (40, 90) further comprises at least a second cam (101) and at least a second tappet (104) supported by said first and second actuating members (98, 95) and engaged with the second cam (101) to move the first and the second actuating members (98, 95) in the direction (13).

6. Machine according to claim 4, wherein the second actuating member (95) is mounted to swing, under the thrust of the second dosing element (87) and against the action of a relative shock-absorbing device (94) around a third rotation axis (12) parallel to said direction (13).

7. Machine according to claim 1 and further comprising a locking device (84) selectively mobile between a locking position and a release position of the two dosing elements (47, 87); the dosing chamber (59) having a volume substantially equal to zero when the locking device (84) is in its locking position and a determined volume different from zero when the locking device (84) is in its release position.

8. Machine according to claim 1, wherein the first dosing element (47) is a cylinder and the second dosing element (87) is a piston engaged with the cylinder.

9. Machine according to claim 1 and further comprising a drum (16) mounted to rotate around a fourth rotation axis (17) parallel to said direction (13); each said cam (41, 101) being formed on an external surface (29) of the drum (16).

* * * * *